United States Patent [19]

Woodward

[11] 3,932,874

[45] Jan. 13, 1976

[54] BROADBAND TURNSTILE ANTENNA

[75] Inventor: Oakley McDonald Woodward, Princeton, N.J.

[73] Assignee: RCA Corporation, New York, N.Y.

[22] Filed: Sept. 11, 1974

[21] Appl. No.: 505,085

[52] U.S. Cl. ..... 343/795; 343/797

[51] Int. Cl.[2] ..... H01Q 21/26

[58] Field of Search ..... 343/795, 797, 798

[56] References Cited

UNITED STATES PATENTS

| | | | |
|---|---|---|---|
| 2,175,253 | 10/1939 | Carter | 343/795 |
| 2,480,153 | 8/1949 | Masters | 343/797 |
| 2,836,824 | 5/1958 | Raymond | 343/795 |

*Primary Examiner*—Eli Lieberman

*Attorney, Agent, or Firm*—Edward J. Norton; Robert L. Troike

[57] ABSTRACT

A broadband turnstile antenna system is provided by four triangular fan-shaped radiating elements spaced about a vertical tower. Each of the triangular radiating elements is constructed and arranged to present a minimum of vertical height at a feed point near the tower and a vertical height that increases to maximum at the end remote from the tower. The radiating elements are fed with equal power in the relative phase rotation of 0°, 90°, 180° and 270°.

8 Claims, 9 Drawing Figures

BROADBAND TURNSTILE ANTENNA

BACKGROUND OF THE INVENTION

This invention relates to broadcasting antennas and more particularly to a turnstile antenna which provides a low voltage standing wave ratio (VSWR) of about 1.2 or less over a bandwidth ratio of 1.63 to 1, which makes it convenient as a mast-mounted television transmitting antenna over the frequency range from television channel 2 through channel 6 (54 to 88 MHz).

BRIEF DESCRIPTION OF THE INVENTION

A broadcasting, turnstile antenna is provided by four fan-shaped radiators extending horizontally from the tower at 90° intervals. Each of the radiators has a minimum height at the feedpoint near the tower and a height that increases to a maximum at the end remote from the tower. Each of the radiators is supported to the tower by two support members connecting the radiator at or near the ends remote from the tower. To operate this antenna, equal signal energy is coupled to the feed point of the four radiators into relative phase rotation of 0°, 90°, 180° and 270°.

DETAILED DESCRIPTION OF THE INVENTION

A detailed description follows in conjunction with the following drawing wherein.

Figure 1:
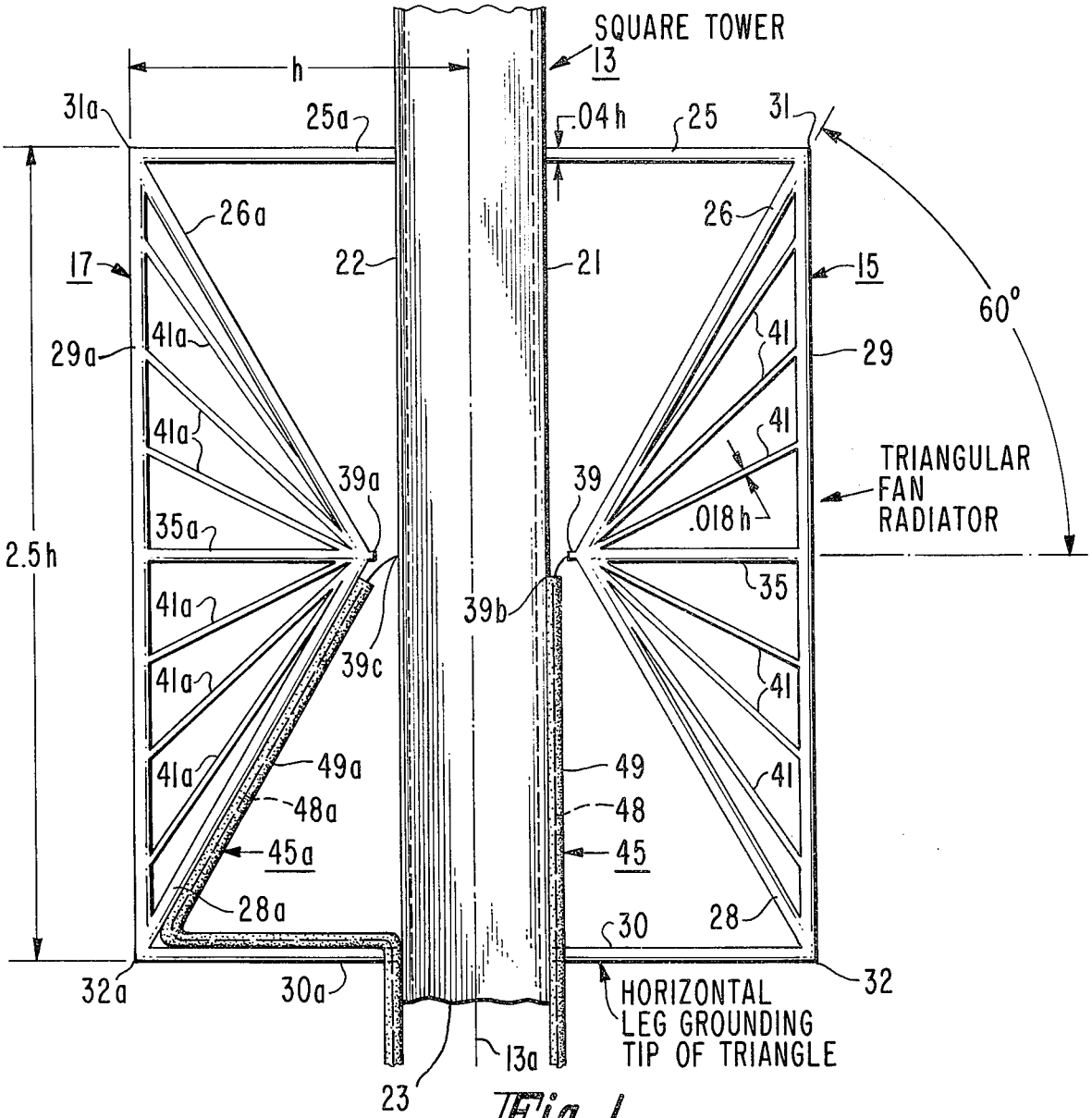
FIG. 1 is a side view of a pair of the radiating elements mounted to a tower according to the present invention.
Figure 2:
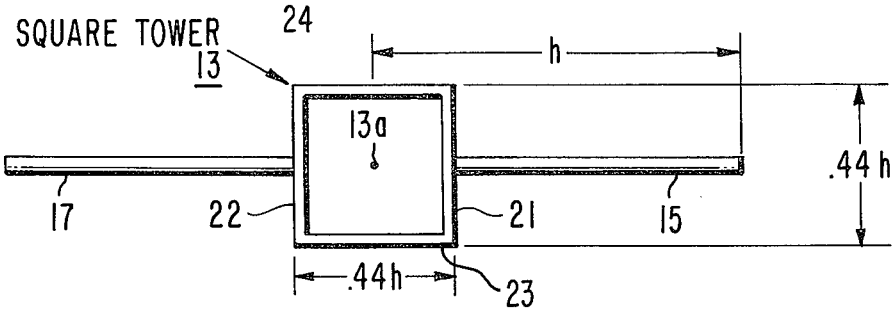
FIG. 2 is a top view of the pair of elements in FIG. 1 mounted to a tower.

Referring to FIGS. 1 and 2, a pair of fan-shaped radiating elements 15 and 17 mounted to a vertically oriented square tower 13 is illustrated. The tower 13 has equal reflective sides 21, 22, 23, and 24. The fan-shaped radiating element 15 is in the form of an isosceles triangle with a side or base 29 extending vertically and parallel to reflective side 21 of tower 13 and with equal length sides 26 and 28 extending diagonally with respect to the side 29 toward the tower 13. The sides 26 and 28 intersect each other at an apex 39 closely spaced from the tower 13. The angle in the embodiment of FIG. 1 between the diagonal sides 26 and 28 near the apex 39 is 120°. The feed points for this radiating element 15 is at the apex 39 and at the point **39*b* on side 21 of tower 13 adjacent apex 39. The corner 31 between the diagonal side 26 and vertical side 29 is connected by a horizontal conductive support member 25 to side 21 of tower 13, and the corner 32 between diagonal side 28 and vertical side 29 is connected by a horizontal conductive support member 30 to side 21 of tower 13.**

Similarly, fan-shaped element 17 is in the shape of an isosceles triangle that has a vertically oriented side of base **29*a* and two equal length diagonal sides 26*a* and 28*a* that join at the apex 39*a* near side 22 of the tower 13. The feed points for this radiating element 17 is at the apex 39*a* and at the point 39*c* on side 22 of tower 13 adjacent apex 39*a*. The angle between the equal diagonal sides 26*a* and 28*a* is 120°. The corner** 31*a* between the diagonal side **26*a* and the vertical side 29*a* is connected by horizontal support member 25*a* to side 22 of tower 13. The corner 32*a* between diagonal side 28*a* and vertical side 29*a* is connected by horizontal support member 30*a* to side 22 of tower 13. These horizontal support members 25, 25*a*, 30, and 30*a*** are metal and not only provide support for the fan-shaped radiating elements but also function to provide lightning protection and broadbanding characteristics to the antenna.

A bisector rod 35 extends from apex 39 perpendicular to vertical side 29 of radiating element 15. Similarly, a bisector rod **35*a* extends from apex 39*a* to vertical side 29*a*. Smaller sized rods 41 extend from apex 39 to equally spaced points on vertical side 29 to form a triangular surface approximating a triangular shaped sheet radiating element. The use of rods approximating a flat triangular conductive sheet rather than a flat sheet is to reduce windloading to the structure. Similarly, smaller sized rods 41*a* extend from feed point 39*a* in element 17 to equally spaced points on vertical side 29*a*.**

One example is given in FIGS. 1 and 2 of the details of the geometry for the pair of radiating elements 15 and 17 for operation over the wide frequency range from television channels 2 through 6 (54 to 88 MHz) when the desired impedance of each fan-shaped radiator element is about 70 ohms. The dimensions are given in terms of $h$ (in inches) which is the horizontal distance from the center **13*a* of the tower 13 in a horizontal direction to the remote vertical edge of vertical sides 29 or 29*a*. The height of the vertical sides 29 and 29*a* is made 2.5h. The sides of the tower are each made 0.44h wide. The diameters of the grounding support members 25, 25*a*, 30, and 30*a*, the diameter of rods making up the vertical sides 29 and 29*a* and the diagonal sides 26, 26*a*, 28, and 28*a* are made 0.04h. The diameter of the bisector rods 35 and 35*a* are made 0.04 h. The diameter of the rods 41 and 41*a* are made 0.018h. The angle between the diagonal rods 26 and 28 and between rods 26*a* and 28*a* is 120°. For this arrangement $h$  0.22λ, where λ is a wavelength at channel 2. For a wavelength at channel 6, $h$ ** 0.34λ. The approximate physical dimensions for such fan-shaped radiators and the tower designed for operation over channels 2 through 6 are below:

Tower (0.44h × 0.44h): 20 × 20 inches
Fan height (2.5h): at 10 feet
Horizontal grounding leg **25, 25*a*, 30 and 30*a***—3 feet
Large support tubes **25, 25*a*, 30, 30*a*, 29, 29*a*, 35 and 35*a*** = 2 inches dia. overall
Small tubes 41 and **41*a*** = 1 inch dia. overall.

Figure 3:
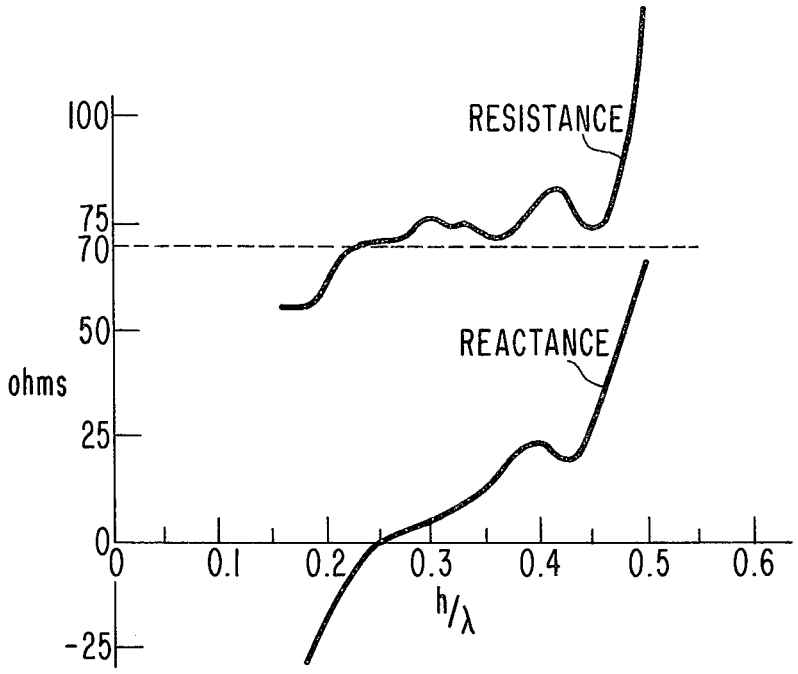
FIG. 3 is a plot of the impedance of a single radiator vs $h/\lambda$.
Figure 4:
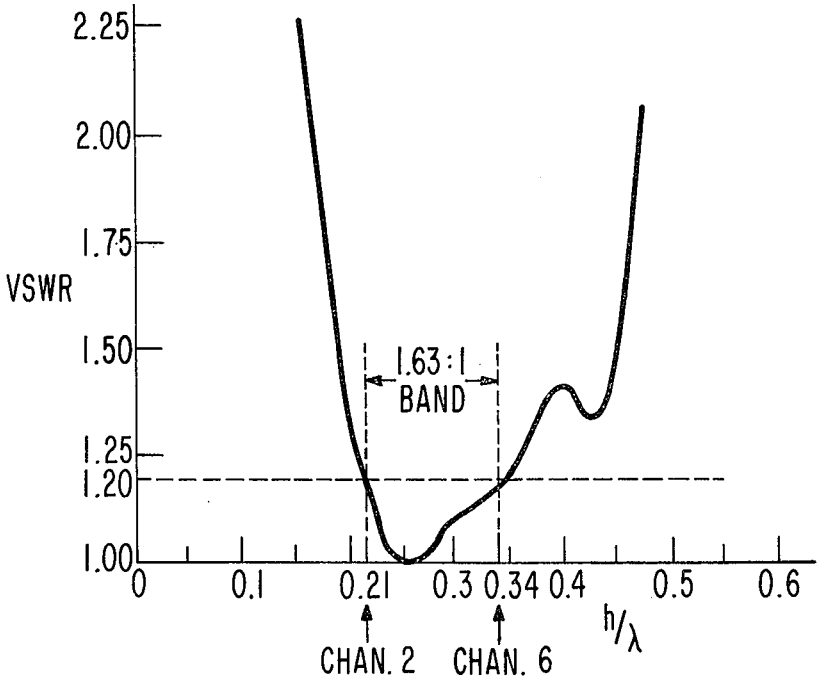
FIG. 4 is a plot of V.S.W.R. on a 70-ohm coaxial line coupled to a single radiator vs $h/\lambda$.
Figure 5:
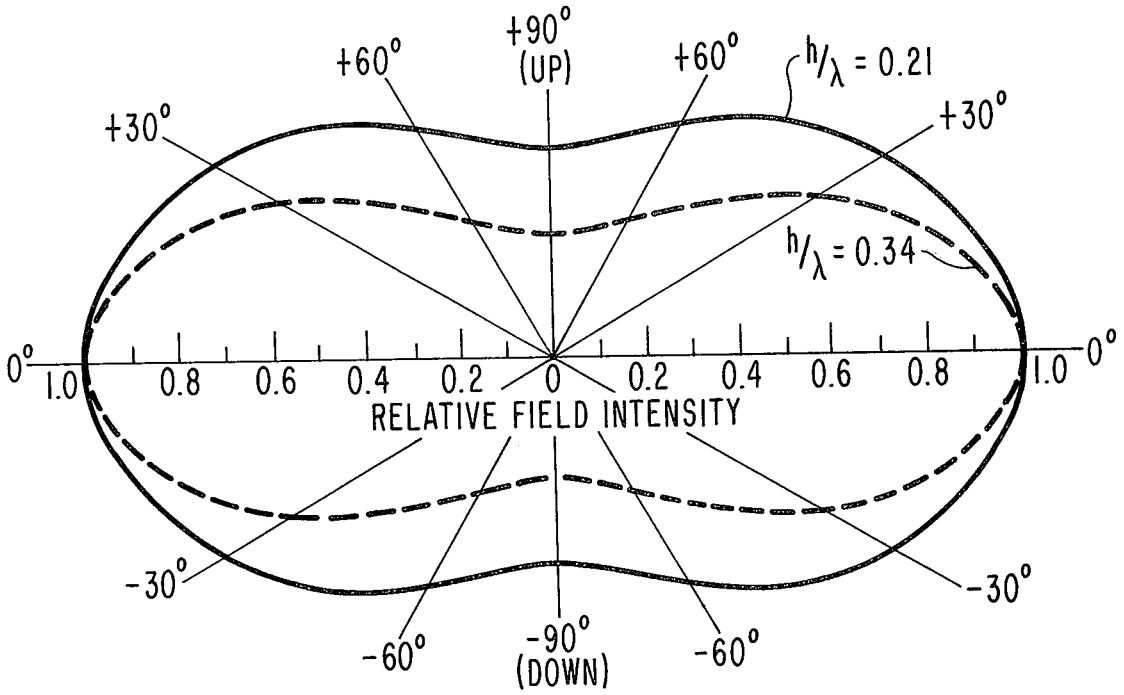
FIG. 5 is an H-plane elevation pattern for the pair of radiators arranged as shown in FIGS. 1 and 2.

FIG. 3 shows the measured impedance of a single fan-shaped radiating element as described above as a function of $h/\lambda$. The antenna system described above is adjusted to present a 70 ohm impedance over as wide a frequency range as possible to match the 70 ohm coaxial transmission feed lines 45 and **45*a*. The lines 45** and 45*a* feed the fan-shaped radiating elements 180° out of phase by, for example, the outer conductor 49 of line 45 being connected to reflective tower 13 and the inner conductor 48 being connected to feed point 39. The outer conductor 49*a* is connected to the fan-shaped element 17 at feed point 39*a* and the inner conductor 48*a* is connected to the tower 13 at point 39*c*. The V.S.W.R. (voltage standing wave ratio) on the standard 70-ohm line with the arrangement shown in FIG. 1 and as described above is shown in FIG. 4. The V.S.W.R. is 1.2 or less over the 54 to 88 MHz frequency band. The horizontally polarized field in the elevation plane measured for the pair of radiators illustrated in FIGS. 1 and 2 and described above is shown in FIG. 5. The patterns corresponding to channels 2 and 6 are plotted. It is seen from FIG. 5 that this single feed point bay has the elevation directivity of several stacked dipoles fed from a corporate network.

Figure 6:
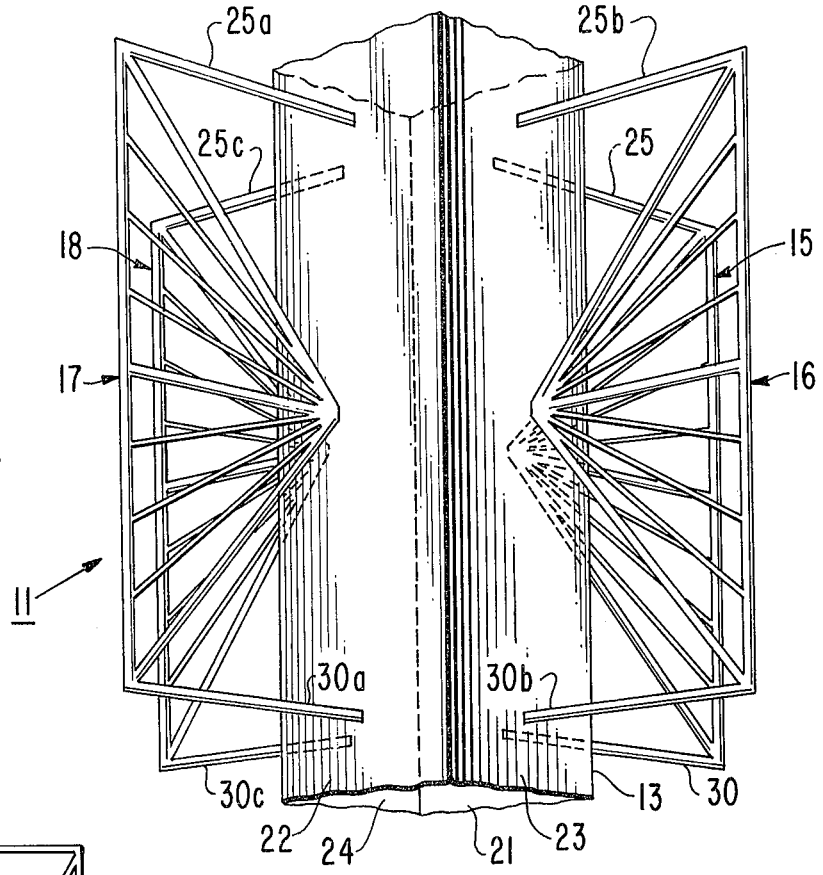
FIG. 6 illustrates a perspective view of a broadband turnstile radiator mounted to a tower according to the present invention.
Figure 7:
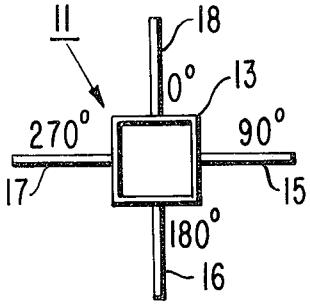
FIG. 7 illustrates the relative phase between the radiators in the system of FIG. 1.

Referring to FIG. 6, the entire turnstile antenna system 11 is shown including the two triangular radiating elements 15 and 17 plus a second pair of triangular radiating elements 16 and 18 identical to the radiating elements 15 and 17 mounted to the vertical tower 13. The radiating elements 15 and 17 are mounted to the sides 21 and 22 of the tower by the support members 25, 30 and 25*a*, 30*a*, respectively, as discussed previously. The radiating elements 16 and 18 are similarly mounted to sides 23 and 24 by support members 25*b*, 30*b* and 25*c* and 30*c*, respectively. The support members 25*b*, 25*c*, 30*b* and 30*c* are identical to the members 25 and 30 discussed above. The radiating elements 15 and 17 are mounted so that they extend in a common plane from diametrically opposite sides 21 and 22 of the tower 13. Likewise, the radiating elements 16 and 18 extend in a common plane from diametrically opposite sides 23 and 24 of the tower 13, as shown in FIGS. 6 and 7. The common plane of the radiating elements 16 and 18 is orthogonal to the common plane of radiating elements 15 and 17 and therefore these radiating elements extend at 90° intervals about the tower 13.

Figure 9:
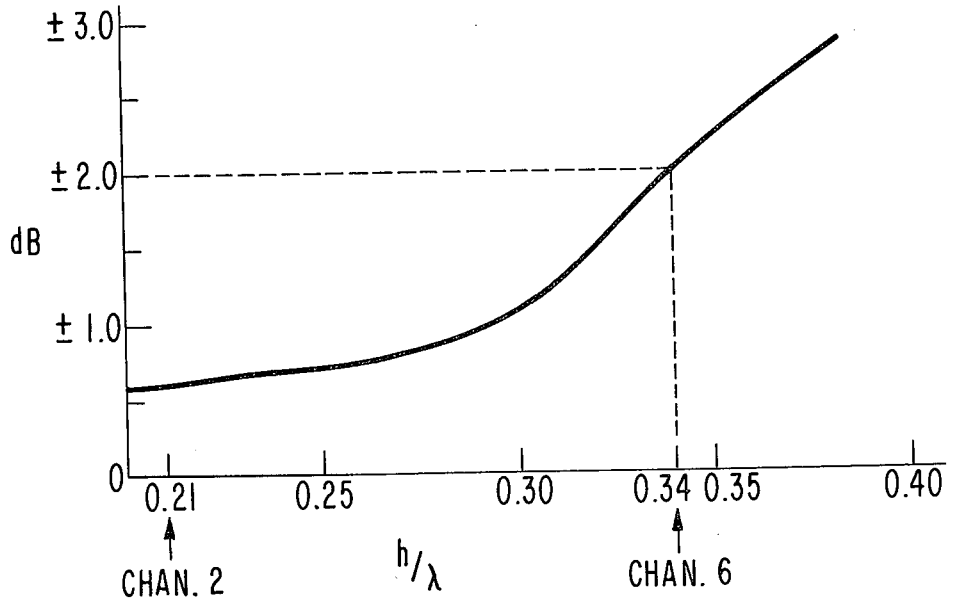
FIG. 9 is a plot of the fluxuation of circularity of the power in db (±) in azimuth about the tower vs $h/\lambda$.
Figure 8:
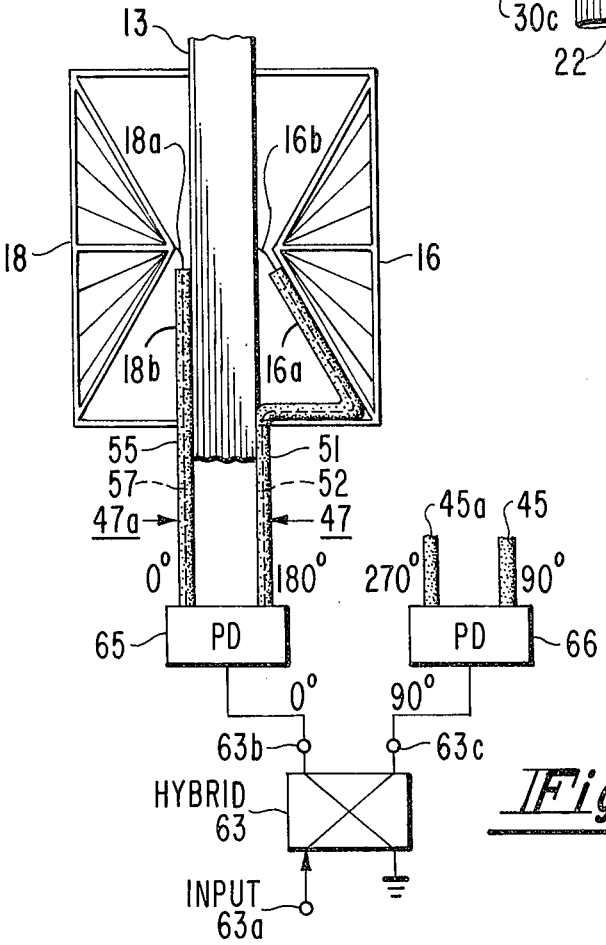
FIG. 8 illustrates the feed system for the turnstile system of FIG. 1.

In a turnstile antenna system, the radiating elements 18, 15, 16 and 17 are fed with equal signal energy in the relative phase rotation of 0°, 90°, 180° and 270° as shown in FIG. 7. This may be achieved by the elements 15 and 17 being fed 180° out of phase in the manner discussed above in connection with FIG. 1 with coaxial feed lines 45 and 45*a* and by elements 16 and 18 being fed 180° out of phase by the arrangement shown in FIG. 8 using coaxial feed lines 47 and 47*a*. The coaxial feed line 47 has an outer conductor 51 connected to radiating element 16 at feed point 16*a* and an inner conductor 52 connected to tower 13 at a point 16*b* adjacent feed point 16*a*. The coaxial feed line 47*a* has an outer conductor 55 connected to tower 55 and which terminates at a point 18*b* adjacent feed point 18*a* and an inner conductor 57 connected to radiating element 18 at feed point 18*a*. The input power to the turnstile antenna system 11 is coupled to a 3db hybrid 63 at terminal 63*a*. This input power is equally power divided with one half the power at a reference phase coupled via output terminal 63*b* to power divider 65 and the other half of the power 90° phase shifted relative to the reference phase coupled via terminal 63*c* to power divider 66. The power divider 65 equally divides the power between coaxial lines 47*a* and 47. The power divider 66 equally divides the power between coaxial lines 45 and 45*a*. The result is that the elements 18, 15, 16 and 17 are fed in the relative phase rotation of 0°, 90°, 180° and 270° as shown in FIG. 7. With this arrangement an almost omnidirectional azimuth pattern is produced. Based on the measured azimuth patterns of FIG. 5, the azimuth circularity for the complete turnstile is illustrated in FIG. 9. The worst circularity is at Channel 6 and is ± 2db, a value usually considered acceptable.

In the arrangements described above, the sides 21 22, 23 and 24 of the tower 13 form a square tower. The tower itself may be round and the surface of each reflective side may be either a continuous conductive sheet or may be a series of rods approximating a good conductive surface without the windloading associated with a continuous surface.

What is claimed is:

1. A turnstile antenna system comprising:

a vertical tower of reflective material, four triangle-shaped radiating elements extending horizontally from said tower at 90° intervals, each radiating element being mounted to said tower with two sides of the triangle extending from an apex near the tower to a base parallel and remote from said tower, whereby said radiating element has a minimum height at the feed point near the tower and a height that increases linearly to a maximum at said base remote from said tower, each of said radiating elements being supported to the tower by a conductive support member connecting the radiating element at or near said base to said tower, and means for feeding equal signal energy to the feed points of said radiators in the relative phase rotation of 0°, 90°, 180° and 270°.

2. The combination claimed in claim 1 wherein said radiating element includes three conductive rods arranged in a triangle.

3. The combination claimed in claim 1 wherein said radiating element is in the shape of an isosceles triangle with the equal sides extending to the apex near the tower and the base being parallel to the tower.

4. The combination claimed in claim 3 wherein the angle at said apex between said two equal sides is about 120°.

5. The combination claimed in claim 4 wherein said radiating elements include a plurality of conductive rods extending between said apex and said base.

6. The combination claimed in claim 4 wherein said support members extend horizontally between said tower and points on said radiator near the ends of said base.

7. The combination claimed in claim 1 wherein the height of said radiating element at the base is about 2.5*h*, where *h* in inches equals the distance said remote end is located horizontally from the center of said tower.

8. The combination as claimed in claim 7 wherein said tower has a width of about 0.44*h*.

* * * * *

UNITED STATES PATENT OFFICE
CERTIFICATE OF CORRECTION

PATENT NO. : 3,932,874

DATED : January 13, 1976

INVENTOR(S) : Oakley McDonald Woodward

It is certified that error appears in the above-identified patent and that said Letters Patent are hereby corrected as shown below:

Column 2, lines 50 and 51 " ** " should be -- ≃ --.

Signed and Sealed this

*eleventh* Day of *May 1976*

[SEAL]

*Attest:*

RUTH C. MASON
*Attesting Officer*

C. MARSHALL DANN
*Commissioner of Patents and Trademarks*